US006695182B1

(12) United States Patent
Shrewsbury

(10) Patent No.: US 6,695,182 B1
(45) Date of Patent: Feb. 24, 2004

(54) EXTENDABLE SHOEHORN DEVICE

(76) Inventor: Terrance L. Shrewsbury, 9 Carney Dr., Charleston, WV (US) 25312

( * ) Notice: Subject to any disclaimer, the term of this patent is extended or adjusted under 35 U.S.C. 154(b) by 0 days.

(21) Appl. No.: 10/093,999

(22) Filed: Mar. 11, 2002

(51) Int. Cl.[7] ..... A47G 25/80
(52) U.S. Cl. ..... 223/113; 223/118
(58) Field of Search ..... 223/113, 118; 135/141, 142

(56) References Cited

U.S. PATENT DOCUMENTS 2,939,618 A * 6/1960 Mangels ..... 223/113
4,793,646 A * 12/1988 Michaud, Jr. ..... 294/19.1
5,961,012 A * 10/1999 Bucher ..... 223/119
6,213,672 B1 * 4/2001 Varga ..... 403/109.2

* cited by examiner

*Primary Examiner*—John J. Calvert
*Assistant Examiner*—James Smith

(57) ABSTRACT

An extendable shoehorn device for permitting a user to put a shoe on a foot without having to bend over. The extendable shoehorn device includes a handle assembly. An offset shoehorn member is mounted to an end of the handle assembly for permitting a user to more easily put a shoe on their foot.

6 Claims, 3 Drawing Sheets

EXTENDABLE SHOEHORN DEVICE

BACKGROUND OF THE INVENTION

1. Field of the Invention

The present invention relates to shoe horns and more particularly pertains to a new extendable shoehorn device for permitting a user to put a shoe on a foot without having to bend over.

2. Description of the Prior Art

The use of shoehorns is known in the prior art. More specifically, shoehorns heretofore devised and utilized are known to consist basically of familiar, expected and obvious structural configurations, notwithstanding the myriad of designs encompassed by the crowded prior art that have been developed for the fulfillment of countless objectives and requirements.

Known prior art includes U.S. Pat. No. Des. 302,490; U.S. Pat. No. 3,788,531; U.S. Pat. No. 4,355,745; U.S. Pat. No. 5,884,823; U.S. Pat. No. 1,424,030; and U.S. Pat. No. 1,242,615.

The use of shoehorns has been known for quite some time. They have taken on many different shapes and sizes. However, the main function of shoehorns has not changed. They are still employed to aid a user in positioning their foot into a shoe. Conventional shoehorns have employed elongate handles to aid users unable to bend over. However, these shoehorns require a user to position the elongate handle behind them, making operation of the shoehorn difficult. Other conventional shoehorns have employed means of collapsing the shoehorn thereby making transportation of the shoehorn easier. Unfortunately, the collapsible shoehorns are small and compact making them unusable for users that are not able to bend over to position the shoehorn behind their foot. Although shoehorns have been improved upon over the years there is still a need for a collapsible shoehorn device that can be easily used.

In these respects, the extendable shoehorn device according to the present invention substantially departs from the conventional concepts and designs of the prior art, and in so doing provides an apparatus primarily developed for the purpose of permitting a user to put a shoe on a foot without having to bend over.

SUMMARY OF THE INVENTION

In view of the foregoing disadvantages inherent in the known types of shoehorns now present in the prior art, the present invention provides a new extendable shoehorn device construction wherein the same can be utilized for permitting a user to put a shoe on a foot without having to bend over.

While the conventional devices fulfill their respective, particular objectives and requirements, the aforementioned patents do not disclose a new extendable shoehorn device. The inventive device includes a handle assembly. An offset shoehorn member is mounted to an end of the handle assembly for permitting a user to more easily put a shoe on their foot.

It is an object of the present invention to provide a new extendable shoehorn device which has many of the advantages of the shoehorns mentioned heretofore and many novel features that result in a new extendable shoehorn device which is not anticipated, rendered obvious, suggested, or even implied by any of the prior art shoehorns, either alone or in any combination thereof.

Another object of the present invention is to provide a new extendable shoehorn device that reduces muscle tension and strain that often occurs when a user has difficulty reaching and putting a shoe on their foot. The present invention also promotes a sense of independence by reducing a users dependency upon another individual to get dressed.

Still another object of the present invention is to provide a new extendable shoehorn device that reduces the muscle tension and strain experienced by shoe salespersons repeated bending over to help customers try on shoes. The present invention permits a shoe salesperson to help a customer position their foot into shoe while standing to the side of the customer.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. It is important, therefore, that the claims be regarded as including such equivalent constructions insofar as they do not depart from the spirit and scope of the present invention.

BRIEF DESCRIPTION OF THE DRAWINGS

The drawings illustrating the present invention include.

DESCRIPTION OF THE PREFERRED EMBODIMENT

Figure 1:
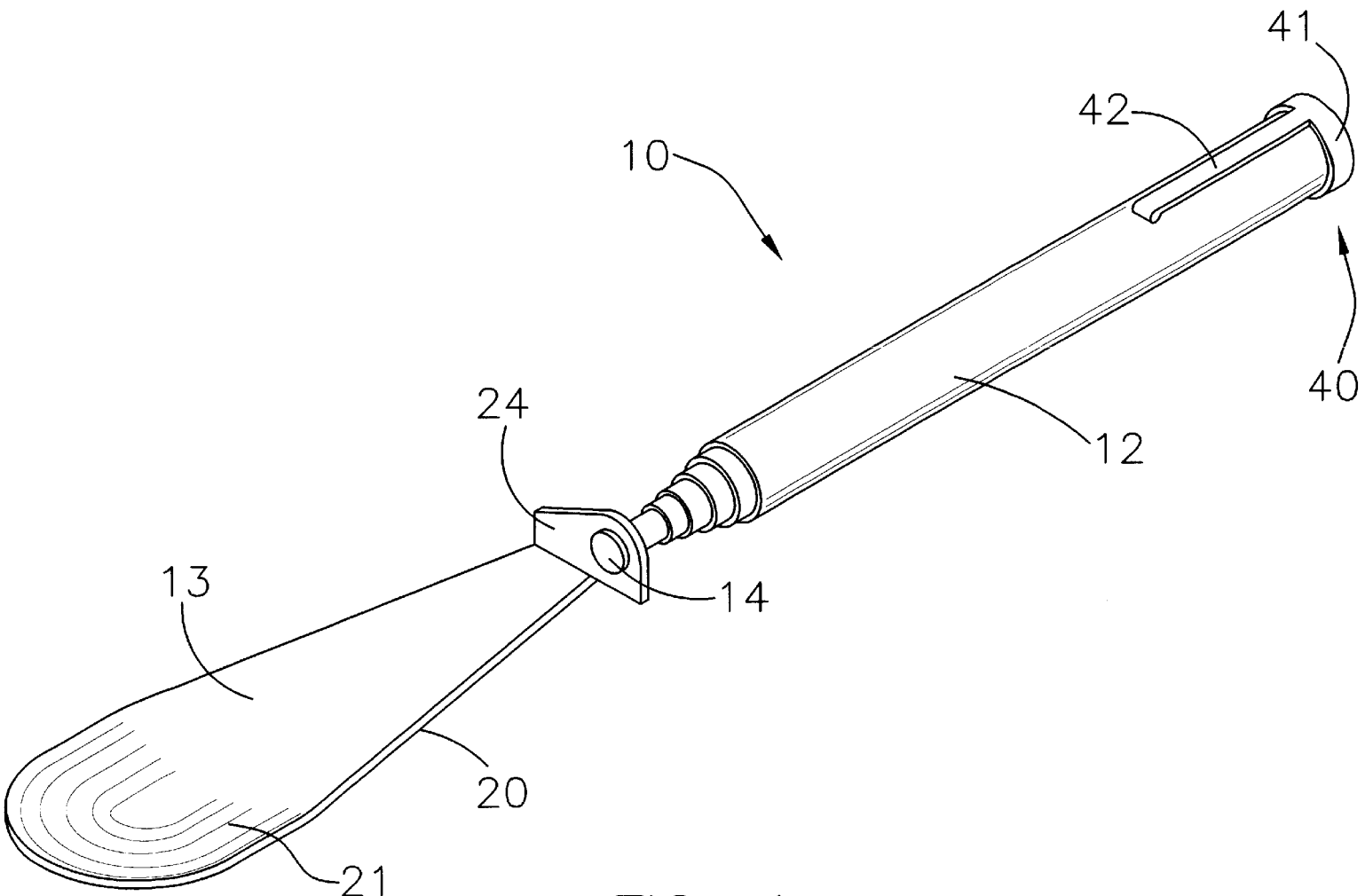
FIG. 1 is a perspective view of a new extendable shoehorn device according to the present invention illustrating a retracted position.

With reference now to the drawings, and in particular to FIGS. 1 through 4 thereof, a new extendable shoehorn device embodying the principles and concepts of the present invention and generally designated by the reference numeral 10 will be described.

As best illustrated in. FIGS. 1 through 4, the extendable shoehorn device 10 generally comprises a handle assembly 12 and an offset shoehorn member 13 that is mounted to an end 14 of the handle assembly 12 for permitting a user to more easily put a shoe on their foot.

Figure 2:
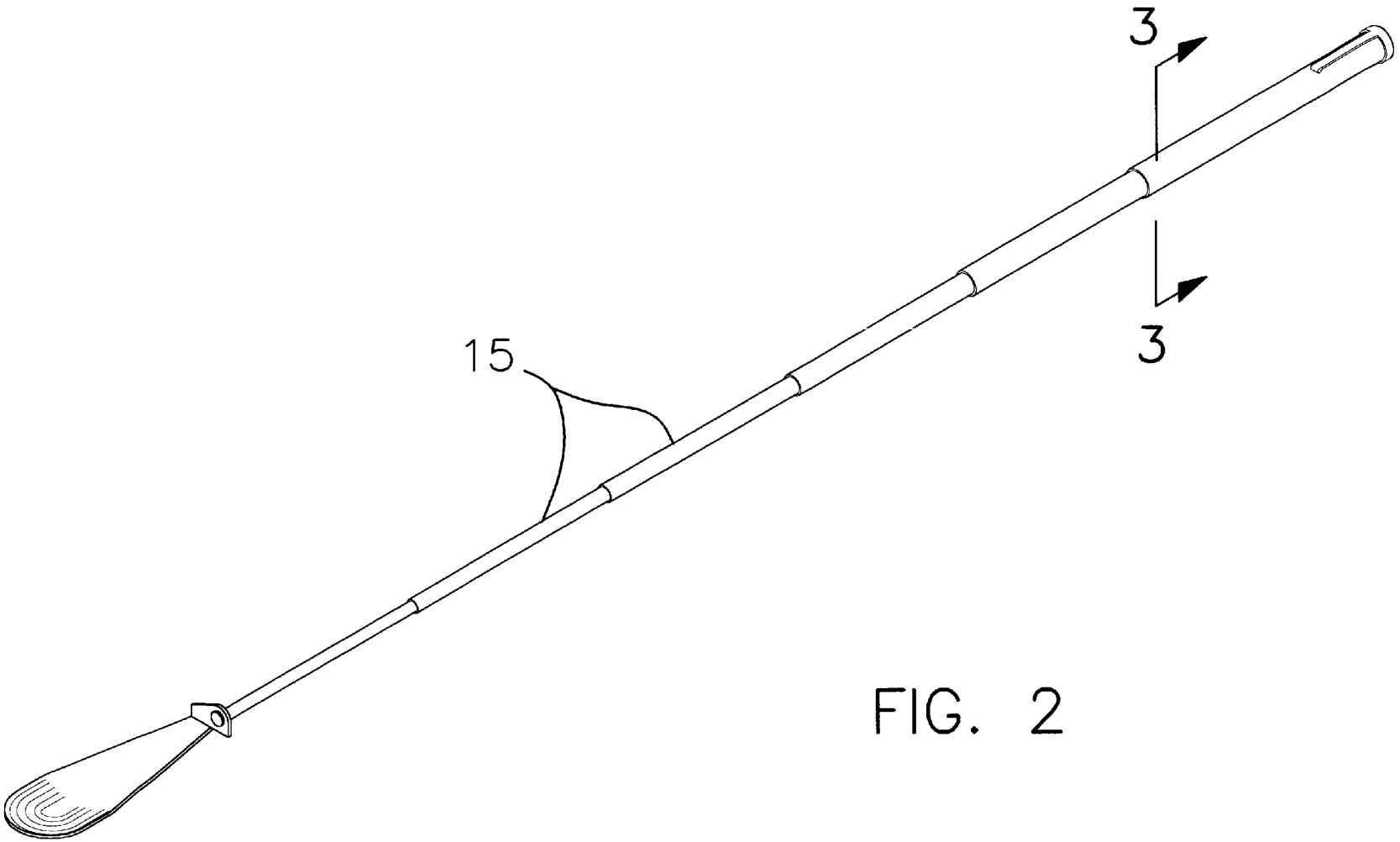
FIG. 2 is a perspective view of the present invention illustrating an extended position.

As illustrated in FIG. 2, the handle assembly 12 may include a plurality of tubular segments 15 that are telescopically interconnected. Each of the tubular segments 15 has first 16 and second 17 opposed ends. As particularly illustrated in FIG. 4, each of the tubular segments 15 may have a generally circular transverse cross section taken substantially perpendicular to a longitudinal axis of each of the tubular segments 15.

The handle assembly 12 may be positionable between a retracted position and an extended position. As illustrated in FIG. 2, the extended position is characterized by the first end 16 of each of the tubular segments 15 being positioned generally adjacent to the second end 17 of an adjacent tubular segment 15. As illustrated in FIG. 1, the retracted position is characterized by the first 16 and second 17 ends of each of the tubular segments 15 being positioned generally adjacent to a respective first 16 and second 16 ends of an adjacent tubular segment 15.

The offset shoehorn member 13 may include a plate 20 that has a generally concave upper surface 21 for selectively abutting a foot of a user. The offset shoehorn member 13 may have a width that tapers from a free end toward the handle assembly 12. The offset shoehorn member 13 may comprise a substantially rigid material such as, for example, a plastic or metal material. However other types of materials may also be employed.

The offset shoehorn member 13 may also include a tab 24 that extends angularly away from the upper surface 21 of the offset shoehorn member 12. The end 14 of the handle assembly 12 is mounted to the tab 24. The tab 24 may have a width tapering from a juncture of the handle assembly 12 and the tab 24 toward a juncture of the tab 24 and the plate 20 of the offset shoehorn member 13.

The tab 24 and plate 20 of the offset shoehorn member 13 are positioned such that a longitudinal axis of the shoehorn member 13 is orientated generally parallel to a longitudinal axis of the handle assembly 12. It is to be understood that various orientations are possible and would fall within the scope of the present invention.

In one embodiment of the present invention, as illustrated in FIG. 2, each of the tubular segments 15 has an inner diameter. The inner diameter of each of the tubular segments 15 may be generally smaller than an adjacent tubular segment 15 such that the handle assembly 12 tapers toward the offset shoehorn member 13.

Figure 3:
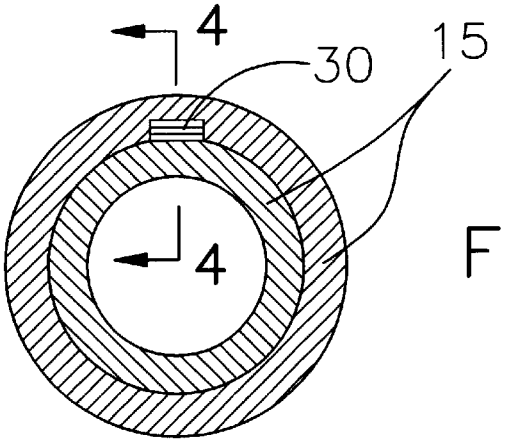
FIG. 3 is a cross sectional view of the present invention taken along line 3—3 of FIG. 2.
Figure 4:
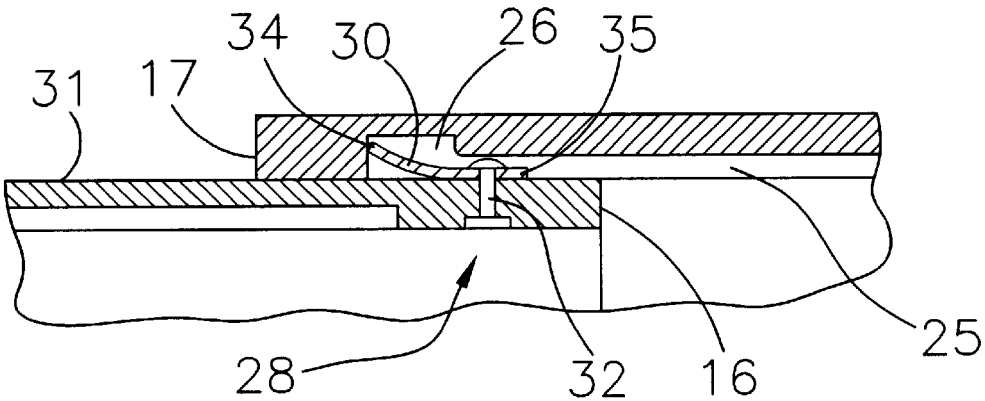
FIG. 4 is a fractional cross sectional view of the present invention taken along line 4—4 of FIG. 3.

In one embodiment of the present invention, as illustrated in FIGS. 3 and 4, each of the tubular segments 15 may include a longitudinal channel 25 that extend between the first 16 and second 17 ends of each of the tubular segments 15. A recess 26 may extend into the longitudinal channel 25 and may be positioned generally adjacent to the second end 17 of each of the tubular segments 15.

As illustrated in FIG. 4, a plurality of securing assemblies 28 may also be provided. Each of the securing assemblies 28 may be mounted to the first end 16 of each of the tubular segments 15 for selectively engaging the second end 17 of an adjacent tubular segment 15 thereby preventing rotational movement of each of the tubular segments 15 with respect to each other when the handle assembly 12 is in an extended position.

In one embodiment of the present invention, each of the securing assemblies 28 may include a spring member 30 that is mounted to an outer surface 31 of each of the tubular segments 15 for selectively engaging the recess 26 thereby preventing rotation of each of the tubular segments 15. Each of the securing assemblies may additionally include a fastening member 32 that may extend through the spring member 30 and may be mounted to the tubular segment thereby fastening the spring member 30 to each of the tubular segments 15.

The spring member 30 preferably has first 34 and second 35 opposed ends. Additionally, the spring member 30 may be generally arcuate such that the first end 34 of the spring member 30 selectively engages the recess 26 when the handle assembly 12 is in the extended position. The spring member 30 may comprise a leaf spring and the fastening member 32 may comprise a pin. However, other types of spring members and fastening members may be employed.

A means of securing 40 the handle assembly 12 to an article may be mounted to the handle assembly 12. The means of securing 40 the handle assembly 12 may include an end cap portion 41 that is mounted to an end of the handle assembly 12 opposite the offset shoehorn member 13. An elongate clip portion 42 may extend longitudinally from the end cap portion 41 toward the offset shoehorn member 13. The means of securing 40 the handle assembly 12 to an article may comprise a substantially rigid material. However, other types of materials may also be employed.

In use, a user grasps the offset shoehorn member 13 and the handle assembly 12. The user positions the handle assembly 12 in the extended position by pulling the offset shoehorn member 13 and the handle assembly 12 away from each other. Once the handle assembly 12 is in the extended position the user positions the first surface 21 of the plate 20 between their foot and the heel grip portion of a shoe. The handle assembly 12 is positioned at side of a user's leg instead of behind the user's leg permitting a user to more easily manipulate the offset shoehorn member 13. Once a user has positioned their foot in a shoe the handle assembly 12 may be positioned in the retracted position for easy transportation with the means of securing 40 the handle assembly 12.

The foregoing is considered as illustrative only of the principles of the extendable shoehorn device. Other modifications and embodiments of the present invention are possible and fall within the present scope of the invention.

I claim:

1. An extendable shoehorn device for positioning between a heel of a user and a heel grip portion of a shoe, said device comprising:

a handle assembly;

an offset shoehorn member being mounted to an end of said handle assembly for permitting a user to more easily put a shoe on their foot, wherein said offset shoehorn member includes:

a plate having a generally concave upper surface for selectively abutting a foot of a user; and a tab extending angularly away from said upper surface of said offset shoehorn member, an end of said handle assembly being mounted to said tab, wherein said offset shoehorn member has a longitudinal axis orientated generally parallel to a longitudinal axis of said handle assembly.

2. An extendable shoehorn device, for positioning between a heel of a user and a heel grip portion of a shoe, said device comprising:

a handle assembly having a plurality of tubular segments telescopically interconnected, each of said segments having first and second opposed ends, each of said tubular segments includes a longitudinal channel extending between said first and second ends of each of said tubular segments and a recess extending into said longitudinal channel, said recess being positioned generally adjacent to said second end of each of said tubular segments;

a plurality of securing assemblies, each of said securing assemblies being mounted to an outer surface of said first end of each of said tubular segments for selectively engaging said second end of an adjacent segment thereby preventing rotational movement of each of said tubular segments with respect to each other when said handle assembly is in an extended position; and an offset shoehorn member being mounted to an end of said handle assembly for permitting a user to more easily put a shoe on their foot.

3. The extendable shoehorn device of claim 2, wherein each of said securing assemblies includes:

a spring member mounted to an outer surface of each of said tubular segments for selectively engaging said recess and preventing rotation of each of said tubular segments; and a fastening member extending through said spring member and being mounted to said segment for fastening said spring member to each of said tubular segments.

4. The extendable shoehorn device of claim 3, wherein said spring member has first and second opposed ends, said spring member being generally arcuate such that said first end selectively engages said recess when said handle assembly is in an extended position.

5. The extendable shoehorn device of claim 3, wherein said spring member comprises a leaf spring.

6. The extendable shoehorn device of claim 3, wherein said fastening member comprises a pin.

* * * * *